US010400294B2

(12) United States Patent
Cartmill

(10) Patent No.: US 10,400,294 B2
(45) Date of Patent: Sep. 3, 2019

(54) DEVICE FOR INSERTING A REFRACTORY BLOCK INTO A TAPHOLE STRUCTURE OF A METALLURGICAL VESSEL, IN PARTICULAR A BASIC OXYGEN FURNACE

(71) Applicant: Refractory Intellectual Property GmbH & Co. KG, Vienna (AT)

(72) Inventor: Colin Cartmill, East Goulais River (CA)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 174 days.

(21) Appl. No.: 15/527,747

(22) PCT Filed: Nov. 3, 2015

(86) PCT No.: PCT/EP2015/075621

§ 371 (c)(1),
(2) Date: May 18, 2017

(87) PCT Pub. No.: WO2016/102110

PCT Pub. Date: Jun. 30, 2016

(65) Prior Publication Data

US 2017/0327913 A1 Nov. 16, 2017

(30) Foreign Application Priority Data

Dec. 22, 2014 (EP) ..... 14199838

(51) Int. Cl.
*C21C 5/44* (2006.01)
*F27D 3/15* (2006.01)
*C21B 7/12* (2006.01)

(52) U.S. Cl.
CPC ..... *C21C 5/445* (2013.01); *F27D 3/1536* (2013.01); *C21B 7/12* (2013.01)

(58) Field of Classification Search
CPC ..... C21B 7/12; C21C 5/445; F27D 3/1536
(Continued)

(56) References Cited

U.S. PATENT DOCUMENTS 4,384,706 A 5/1983 Shirasaka et al.
4,637,590 A 1/1987 Schneider
(Continued)

FOREIGN PATENT DOCUMENTS

DE 102010056117 * 4/2012 ..... C21C 5/445
DE 102010056117 B3 4/2012
(Continued)

OTHER PUBLICATIONS

DE102010056117, Conrad-Joachim, Converter tapping hole and closure assembly, Apr. 19, 2012, 9pages (Year: 2012).*
Abstract of DE 102010056117 B3.

*Primary Examiner* — Scott R Kastler
*Assistant Examiner* — Michael Aboagye
(74) *Attorney, Agent, or Firm* — Brian Roffe

(57) ABSTRACT

Device for inserting a refractory block into a taphole structure of a metallurgical vessel, in particular a basic oxygen furnace wherein the refractory block is carried by a mounting unit and has a proximate end introducable into the taphole. A distal end with locking elements, which can be coupled to a locking plate of the vessel, is disposed at the outside of the taphole of the vessel. The refractory block can be introduced into the taphole structure until the locking elements of the mounting unit can be attached to and coupled with the coupling head with a manipulator. This mounting unit can be uncoupled with the manipulator, when the refractory block is mortared and fixed in the lining, whereby the mounting unit can be decoupled and removed
(Continued)

solely out of the taphole to enable refractory block replacement and gunning of refractory material from the inside of the furnace more easily.

20 Claims, 1 Drawing Sheet

(58) Field of Classification Search
USPC ..... 266/44, 45, 272, 273
See application file for complete search history.

(56) References Cited

U.S. PATENT DOCUMENTS

| | | | | |
|---|---|---|---|---|
| 4,909,487 | A | 3/1990 | Schneider | |
| 6,663,825 | B2 * | 12/2003 | Grant, Jr. | C21C 5/445 266/135 |
| 2001/0007382 | A1 | 7/2001 | Raivo et al. | |
| 2007/0216073 | A1 | 9/2007 | Pungersek et al. | |
| 2008/0093780 | A1 | 4/2008 | Ebisawa et al. | |
| 2016/0313063 | A1 | 10/2016 | Clesen | |

FOREIGN PATENT DOCUMENTS

| | | | |
|---|---|---|---|
| EP | 0726439 | A1 | 8/1996 |
| GB | 2203526 | A | 10/1988 |
| JP | 2004218022 | A | 8/2004 |
| JP | 2004263261 | A | 9/2004 |
| KR | 100832528 | B1 | 5/2008 |
| LU | 90468 | A1 | 6/2001 |
| WO | 20150865557 | A2 | 6/2015 |
| WO | 20160102110 | A1 | 6/2016 |

* cited by examiner

DEVICE FOR INSERTING A REFRACTORY BLOCK INTO A TAPHOLE STRUCTURE OF A METALLURGICAL VESSEL, IN PARTICULAR A BASIC OXYGEN FURNACE

FIELD OF THE INVENTION

The Invention refers to a device for inserting a refractory block into a taphole structure of a metallurgical vessel, in particular a basic oxygen furnace (BOF), whereby the refractory block is carried by a mounting unit and having a proximate end, which can be introduced into the taphole and a distal end with locking elements, which can be coupled to a locking plate disposed at the outside of the taphole of the vessel; and a method for an automatic supply of refractory.

BACKGROUND OF THE INVENTION

Basic Oxygen Steelmaking is a process which employs the injection of oxygen into molten carbon-rich iron to obtain steel with relatively low-carbon content. The iron is processed in a furnace or, more specifically, in a Basic Oxygen Furnace (BOF) having a stout, oblong body lined with refractory material. The BOF is equipped with a taphole structure used for pouring of the finished molten steel through a tapping channel. The taphole structure comprises a tube-shaped removable refractory block consisting of several one after another equipped nozzles that forms in the mounted position the tapping channel which extends from the interior of the furnace and terminates in a casting or turret area of the furnace. Between the refractory block and a surrounding mantle of refractory material an annular gap is defined, which is filled with mortar or the like.

Due to wearing of the refractory block and it's lining refractory material, the refractory block must be removed and replaced relatively often, for example after about 40 to 120 tapping with each by emptying of the melt in the vessel.

The document DE-A-10 2010 056 117 discloses a handling of the replacement of a refractory block from the furnace's exterior. A filling opening, which is formed by a sleeve made of refractory material used in a perforation of the tapping channel with radial clearance, where the ring gap formed by the radial clearance is filled with refractory filler material. The sleeve exhibits an end of first circumferential collar located in the perforation of the tapping channel. The tapping channel near its target position facing the interior of the furnace, which bears the annular gap-bridging at the hole face of the hole provided with the sleeve at its outer end with a stopper-forming second collar and exhibits covered through-holes in the region of the annular gap. The refractory filler material for the annular gap is introduced through the perforations in the annular gap. With such a kind of filling of a viscous refractory material there exists the risk that the annular gap will not be filled completely.

Moreover a further important disadvantage exists in the fact that the inserting and positioning of the sleeve inside the tapping channel with the manipulator is connected with a difficult handling to reach an exact coaxial placement of the sleeve inside the channel.

OBJECTS AND SUMMARY OF THE INVENTION

The object underlying this invention is to avoid this disadvantage and to provide a device for inserting a refractory block into a taphole by avoiding any manual work and to easily locking respectively removing the mounting unit from the vessel.

This object is achieved according to the invention in that the refractory block can be introduced into the taphole until the locking elements of the mounting unit can be attached to and coupled with the coupling head with a manipulator, respectively uncoupled also with the manipulator, when the refractory block is mortared and fixed in the lining, whereby the mounting unit can be decoupled and removed solely out of the taphole.

Very advantageously, after the fastening of the locking elements at the locking plate the refractory block is positioned inside the lining in such a way, that it is surrounded by an annular gap, so that a filling material, like mortar, can be filled into this annular gap at least from the inside of the vessel.

The replacement of a refractory block of a taphole assembly is thus an arduous and dangerous task. There is therefore a need for, and it would be advantageous to have a configuration that enables the refractory block replacement and the gunning of refractory material from the inside of the furnace more easily.

BRIEF DESCRIPTION OF THE DRAWINGS

In the following the invention is described in more detail by means of an exemplary embodiment with reference to the drawings. These are shown as follows.

DETAILED DESCRIPTION OF THE INVENTION

Figure 1:
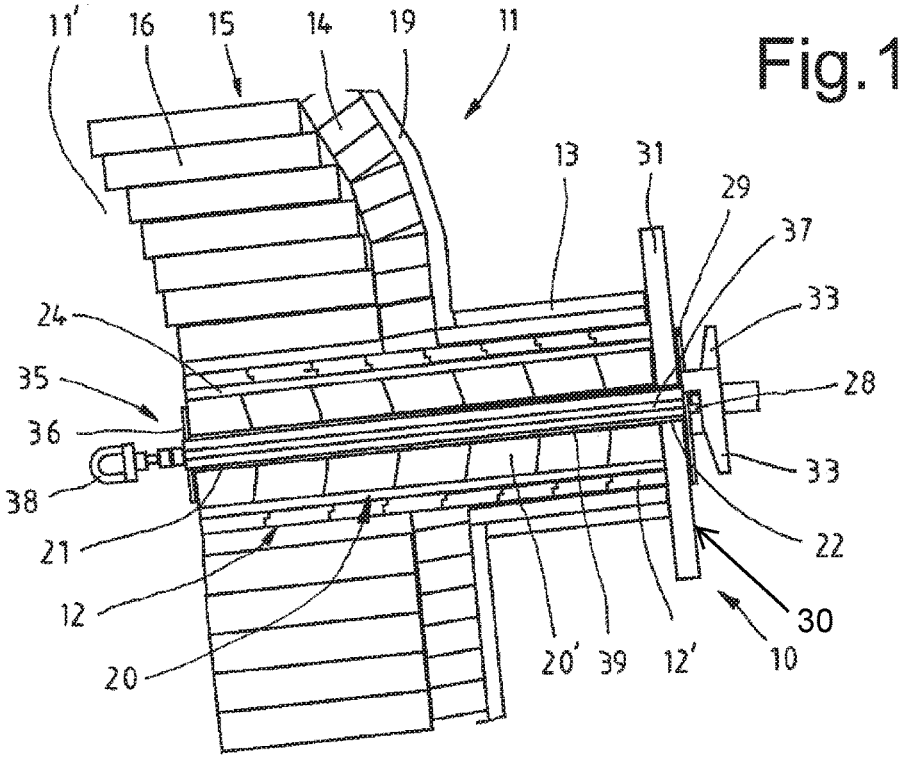
FIG. 1 is a schematic cross-sectional view of a part of a BOF and its taphole structure.

FIG. 1 shows a taphole structure 10 of a metallurgical vessel 11, in particular of a basic oxygen furnace (BOF). The vessel 11 is shown as a BOF but it could also be used with a different type of furnace or vessel, like an electric arc furnace, a ladle or the like, for molten steel or other molten non-ferrous metals.

The vessel 11 in essence consists of an outer steel mantle 19 and a refractory lining 15 with refractory bricks 14 inside the mantle 19 and furthermore, a second lining of bricks 16. The taphole structure 10 of the BOF is usually arranged at the upper side wall and for the tapping of the steel melt, the BOF will be overturned. Advantageously, a protruding neck 13 with a steel mantle 19 is used, where a refractory block 20 with the taphole 21 is inserted and is extending through the protruding neck 13 until it is inside 11' of the BOF. Therewith, also an outlet 22 of the taphole 21 at the end of the protruding neck 13 is respectively provided, where the metal melt will flow out.

Furthermore it is indicated inside the taphole 21 a clamping mechanism 35 of a mounting unit 25, which has a fitting bolt 37 within a tube 39 and a disc 36. The fitting bolt 37 and the tube 39 extend through the tap hole and are mounted with one end at the mounting unit 25 outside and with the other end at the inside 11' of the BOF, where a holding element 38 is provided. This clamping mechanism 35 thereby connects the refractory block 20 to the mounting unit 25 and holds the refractory nozzles 20' together as a jetblock assembly.

Figure 2:
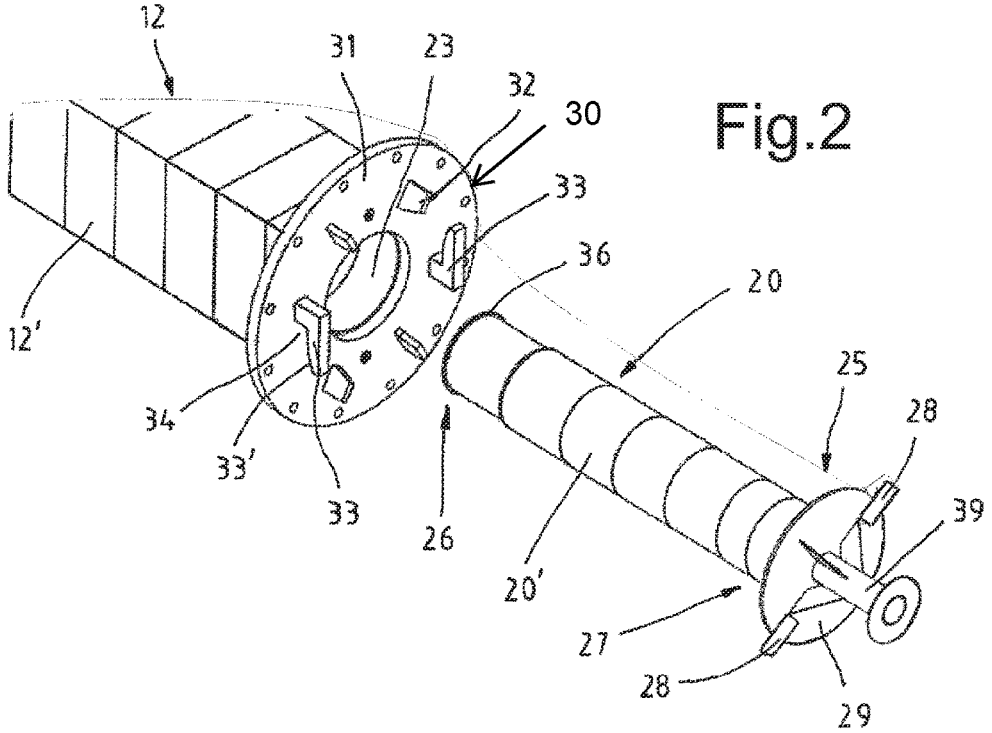
FIG. 2 is a schematic perspective view of a taphole structure without vessel in a disassembled state of the refractory block, according to an embodiment.

According to FIG. 2, the refractory block 20 is carried by this mounting unit 25, which are moveable in an assembled state by a manipulator or a robot (not shown). The refractory block 20 has a proximate end 26, which can be introduced into the opening 23 of the lining 12. An opposite distal end 27 with the mounting unit 25 with locking elements 28 and a flange disc 29 can be coupled to a coupling head 30 after inserting the refractory block 20 into the lining 12. This coupling head 30 has a locking plate 31 with coupling elements 32, 33 disposed at the front side of the protruding neck 13.

According to the invention, the refractory block 20 can be introduced into the taphole structure 10 until the locking elements 28 of the mounting unit 25 can be attached to and coupled with the coupling head 30 with the manipulator, respectively uncoupled also with the manipulator, when the refractory block 20 is mortared and fixed in the lining 12 and the mounting unit 25 can be decoupled and removed solely out of the taphole 21, i.e., without the refractory block 20.

After the fastening of the locking elements 28 at the coupling head 30, the refractory block 20 is positioned inside the lining 12 in such a way that it is surrounded by an annular gap 24, so that a filling material, like mortar, can be gunned into this annular gap 24 at least from the inside of the vessel 11. Thereafter, the filling material is reinforcing, respectively drying and fixing, the refractory block 20 inside the lining 12, whereby this drying time takes approximately 5 to 10 minutes. Afterwards, the mounting unit 25 can be removed solely, without the refractory block 20 by the manipulator.

The manipulator can be handled and driven by the staff in a conventional manner but it could also be used a robot, with which the handling for the supply of the refractory block 20 and all the necessary steps would be completely automated.

At this fastened position, the disc 29 of the mounting unit 25 is in contact with the front side of the locking plate 31 of the coupling head 30. This locking plate 31 has a plurality of hooks 33 circularly arranged at the outside of the protruding neck 13 and the locking elements 28 have a corresponding plurality of bars circularly arranged on the flange disc 29 of the mounting unit 25. In the illustrated embodiment, the four arranged coupling elements 32 on the circumference of the opening 23 form a circle and serve as a centering function for the flange disc 29.

The L-shaped hooks 33, from which are used two oppositely placed to the taphole, form each a recess 34 and having a ramp 33', in which the corresponding bar of the locking elements 28 at the periphery of the flange disc 29 can be introduced by swivelling of the mounting unit 25 around the axis of the taphole, thus with the not shown manipulator. The recesses 34 and the bars are dimensioned so that they can be coupled like a bayonet.

The plurality of hooks 33 have the same orientation with respect to a given first rotational direction and are arranged at a distance from each other matching the arrangement of locking bars, for allowing locking bars to form-fittingly engage with their respective hooks 33 through rotational movement of the refractory block 20 and the mounting unit 25 relative to the lining 12. Clearly, the rotational movement shall be in correspondence with the pointing direction of the hooks 33 for allowing the form-fitting engagement.

The plurality of the hooks 33 may be equidistantly arranged from each other so that each angle formed between two neighboring hooks may be about equal. Correspondingly, the plurality of bars are also equidistantly arranged from each other so that each angle formed between two neighboring bars may be about equal. The two hooks 33 are located opposite each other forming an angle of 180° between each other and, therefore, the two bars are also located opposite each other, forming an angle of 180° between each other.

In another embodiment the locking plate 31 may have more than two hooks 33 arranged thereon and the flange disc 29 may, respectively, have more than two bars arranged thereon. For example, three hooks and three bars (not shown) may be arranged on locking plate 31 and flange disc 29, respectively, at a distance forming for example an angle of about 120° between each other.

The hooks 33 are tapered towards their respective free ends such that the space between locking plate 31 and the L-shaped hook gradually increases towards the free ends. This configuration may facilitate the slidable rotation of bars underneath a hook for interlockingly engaging locking plate with the flange disc.

With a further embodiment of the invention, the bayonet could also be designed in the sense that the L-shaped hooks 33 would be fixed at the outer side of the flange disc 29 also with an extension tangentially and the locking elements 28 would be fixed at the locking plate 31, what is not shown but encompassed within the scope of the invention. With the coupling, when the refractory block 20 is inserted and the mounting unit 25 will be turned, the hooks 33 and the locking elements 28 would then respectively couple in a corresponding arrangement.

The invention claimed is:

1. An arrangement for inserting a refractory block into a taphole of a metallurgical vessel, comprising:

a coupling head, said coupling head including a locking plate arranged outside of the taphole and an arrangement of a plurality of hooks on said locking plate; and a mounting unit that carries the refractory block into the taphole to position the refractory block inside a lining of the taphole, said mounting unit including a flange disc at a distal end and locking elements arranged on said flange disc, said locking elements comprising a plurality of bars in an arrangement corresponding to the arrangement of said plurality of hooks to enable coupling of said plurality of bars and said plurality of hooks together to thereby couple said mounting unit and said coupling head together and fix the refractory block in a position inside the lining.

2. The arrangement of claim 1, wherein the arrangement of said plurality of hooks is a circular arrangement around said locking plate, and the arrangement of said plurality of bars is a corresponding circular arrangement around said flange disc.

3. The arrangement of claim 1, wherein said mounting unit is configured to enable the refractory block to be introduced into the taphole until said locking elements of said mounting unit are attached to and coupled with said coupling head, and separate from the refractory block after the refractory block is mortared and fixed in the lining to be removed out of the taphole without the refractory block.

4. The arrangement of claim 1, wherein said mounting unit is configured to enable the refractory block to be introduced into the taphole until said locking elements of said mounting unit are attached to and coupled with said coupling head in the position in which the refractory block is inside the lining and an annular gap is formed between an outer surface of the refractory block and the lining, whereby a filling material is insertable into the annular gap from inside the vessel.

5. The arrangement of claim 1, wherein said plurality of hooks and said plurality of bars are arranged to enable each of said plurality of bars to be fastened to a respective one of said plurality of hooks.

6. The arrangement of claim 1, wherein said plurality of hooks and said plurality of bars are arranged to enable each of said plurality of bars to engage and come into contact with a respective one of said plurality of hooks.

7. The arrangement of claim 1, wherein said mounting unit is configured relative to said coupling head to cause said flange disc to be positioned against said locking plate in order to enable said plurality of bars to engage with said plurality of hooks.

8. The arrangement of claim 7, wherein said mounting unit is rotatable relative to said coupling head, said mounting unit being rotatable from a position in which said flange disc is against said locking plate with said plurality of bars not in engagement with said plurality of hooks to a position in which said flange disc is against said locking plate and said plurality of bars are engaged with said plurality of hooks to thereby fix said mounting unit to said coupling head.

9. The arrangement of claim 1, wherein said coupling head further comprises centering structure for centering said flange disc.

10. The arrangement of claim 1, wherein said coupling head further comprises coupling elements that form a circle for centering said flange disc.

11. The arrangement of claim 1, wherein each of said plurality of hooks has an L-shape forming a recess between a ramp and a surface of said locking plate, said plurality of hooks being oriented to enable said plurality of bars to enter into said recesses upon rotation of said flange disc relative to said locking plate.

12. The arrangement of claim 11, wherein said recess are dimensioned to receive a respective one of said plurality of bars, whereby said mounting unit is attachable to and couplable with said coupling head in a bayonet fit.

13. The arrangement of claim 1, wherein said locking plate includes an opening and said plurality of hooks comprise two hooks arranged on opposite sides of said opening of said locking plate and opposite one another.

14. The arrangement of claim 13, wherein said plurality of bars comprise two bars arranged on opposite sides of said flange disc and opposite one another.

15. The arrangement of claim 14, wherein said two bars extend outward from a periphery of said flange disc.

16. The arrangement of claim 1, wherein said plurality of bars extend outward from a periphery of said flange disc.

17. The arrangement of claim 1, wherein said mounting unit further comprises a clamping mechanism having a tube extending along a length of said mounting unit and a disc at one end of said tube opposite an end at which said flange disc is situated, said clamping mechanism connecting the refractory block to said mounting unit between said flange disc and said disc.

18. The arrangement of claim 1, wherein said plurality of hooks are equidistantly arranged from each other so that each angle formed between two neighboring hooks is equal, said plurality of bars also being equidistantly arranged from each other so that each angle formed between two neighboring bars is equal.

19. The arrangement of claim 1, wherein each of said plurality of hooks has an L-shape having a free end and is tapered toward said free end such that a space between said locking plate and said hook gradually increases toward said free end.

20. The arrangement of claim 1, wherein said mounting unit is configured and said plurality of hooks are oriented to enable a manipulator or robot to engage with said mounting unit and rotate said mounting unit to cause engagement of said plurality of bars to said plurality of hooks.

* * * * *